US008267030B1

(12) United States Patent
McHugh et al.

(10) Patent No.: US 8,267,030 B1
(45) Date of Patent: Sep. 18, 2012

(54) METHOD AND APPARATUS FOR LAUNCHING WATERCRAFT

(76) Inventors: Benjamin O. McHugh, Saucier, MS (US); Russell R. Necaise, Pass Christian, MS (US)

( * ) Notice: Subject to any disclaimer, the term of this patent is extended or adjusted under 35 U.S.C. 154(b) by 155 days.

(21) Appl. No.: 12/924,935

(22) Filed: Oct. 12, 2010

(51) Int. Cl.
*B63B 21/00* (2006.01)

(52) U.S. Cl. ..... 114/221 R; 114/230.25; 114/344; 280/414.1; 280/414.2

(58) Field of Classification Search ..... 114/221 R, 114/230.2, 230.25, 230.26, 344; 280/414.1, 280/414.2, 414.5
See application file for complete search history.

(56) References Cited

U.S. PATENT DOCUMENTS

| | | | | |
|---|---|---|---|---|
| 3,224,404 | A | 12/1965 | DeJong | |
| 3,861,346 | A | 1/1975 | Pina | |
| 4,519,643 | A | 5/1985 | Harris | |
| 5,003,907 | A | 4/1991 | Roach et al. | |
| 5,190,330 | A * | 3/1993 | Dunham | 114/221 R |
| 6,273,017 | B1 * | 8/2001 | Griffin | 114/230.25 |
| 6,928,945 | B1 | 8/2005 | Tebo, Jr. | |
| 7,810,442 | B2 * | 10/2010 | Duarte et al. | 114/230.2 |
| 2003/0071185 | A1 | 4/2003 | Casapulla | |

* cited by examiner

*Primary Examiner* — Lars A Olson
(74) *Attorney, Agent, or Firm* — George L. Williamson

(57) ABSTRACT

A method and apparatus which will allow a single person to launch and secure a boat or watercraft to a pier without the user getting into the water and which allows the user to maintain control of the vessel or watercraft. Disclosed is a bracket mounted near the tongue of a boat trailer which has a tube for holding a telescoping pole which pole is removably, insertable into the tube so that when the boat on the trailer is backed into the water in preparation for launching the boat an attachment ring on the end of the boat lanyard is attached to the bow cleat of the boat so as to assist in maneuvering the boat off of the trailer. Thereafter, the pole is removed from the tube and the loop on the end of the pole is connected to a stern cleat on the rear of the boat so as to then allow the user to pull the boat toward the pier.

11 Claims, 2 Drawing Sheets

METHOD AND APPARATUS FOR LAUNCHING WATERCRAFT

BACKGROUND OF THE INVENTION

1. Field of the Invention

The present invention relates generally to accessories for watercraft and, more particularly, is concerned with a method and apparatus for launching a watercraft.

2. Description of the Prior Art

Methods for launching watercraft have been described in the prior art, however, none of the prior art devices disclose the unique features of the present invention.

In U.S. Pat. No. 3,224,404 dated Dec. 21, 1965, DeJong disclosed a mooring device having a pole associated therewith. In U.S. Patent Application Publication 2003/0071185 dated Apr. 17, 2003, Casapulla disclosed a flag pole holder for a trailer hitch. In U.S. Pat. No. 6,928,945 dated Aug. 16, 2005, Tebo, Jr. disclosed a boat docking aid. In U.S. Pat. No. 5,586,514 dated Dec. 24, 1996, Yuscavage disclosed a mooring device. In U.S. Pat. No. 5,003,907 dated Apr. 2, 1991, Roach, et al., disclosed a boat hook. In U.S. Pat. No. 4,519,643 dated May 28, 1985, Harris disclosed a handle for extending the reach of a rope. In U.S. Pat. No. 3,861,346 dated Jan. 21, 1975, Pina disclosed a boat docking tool. While these methods for launching a watercraft may be suitable for the purposes for which they were designed, they would not be as suitable for the purposes of the present invention as hereinafter described.

SUMMARY OF THE PRESENT INVENTION

The present invention discloses a method and apparatus which will allow a single person to launch and secure a boat or watercraft to a pier without the user getting into the water and which allows the user to maintain control of the vessel or watercraft. Disclosed is a bracket mounted near the tongue of a boat trailer which has a tube for holding a telescoping pole which pole is removably, insertable into the tube so that when the boat on the trailer is backed into the water in preparation for launching the boat an attachment ring on the end of the boat lanyard is attached to the bow cleat of the boat so as to assist in maneuvering the boat off of the trailer. Thereafter, the pole is removed from the tube and the loop on the end of the pole is connected to a stern cleat on the rear of the boat so as to then allow the user to pull the boat toward the pier.

An object of the present invention is to allow a single person to launch and secure a boat from a trailer to a pier. A further object of the present invention is to allow a user to launch and secure a boat using a pole which is mounted onto the trailer upon which the boat is being towed. A further object of the present invention is to provide a launching mechanism which can be easily and simply used. A further object of the present invention is to provide a launching mechanism which is relatively inexpensive to manufacture.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
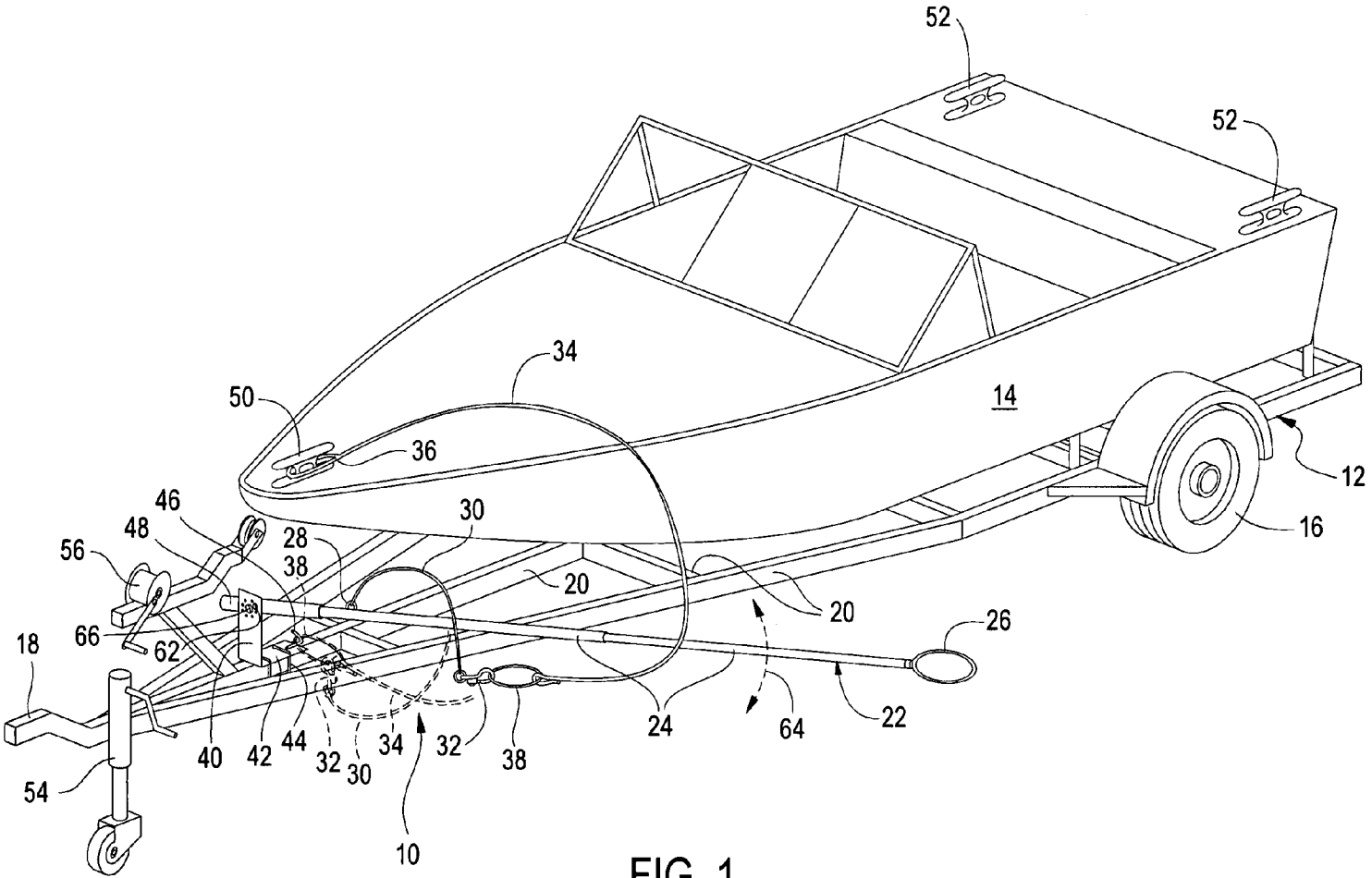
FIG. 1 is a perspective view of the present invention shown in operative connection.

With regard to reference numerals used, the following numbering is used throughout the drawings.

| | |
|---|---|
| 10 | present invention |
| 12 | trailer |
| 14 | boat |
| 16 | wheel |
| 18 | tongue |
| 20 | frame member |
| 22 | pole |
| 24 | telescoping sections |
| 26 | loop |
| 28 | ring |
| 30 | pole lanyard |
| 32 | spring loaded connector |
| 34 | boat lanyard |
| 36 | attachment ring |
| 38 | attachment ring |
| 40 | bracket |
| 42 | base |
| 44 | U-bolts |
| 46 | hook |
| 48 | holder tube |
| 50 | bow cleat |
| 52 | stern cleat |
| 54 | stand |
| 56 | winch |
| 58 | user |
| 60 | pier |
| 62 | pin |
| 64 | arrow |
| 66 | pivot |

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1-4 illustrate the present invention wherein a method and apparatus for launching a watercraft is disclosed.

Turning to FIGS. 1-4, therein is shown the present invention 10 along with a trailer 12 having a boat or similar watercraft 14, including a personal watercraft, mounted thereon, the trailer having wheels 16, tongue 18, stand 54 and comprising a plurality of frame members 20 for supporting the boat thereon. Also shown is a pole 22, having a plurality, e.g., three, of user-selected telescoping sections 24 along with a loop 26 or like on its distal end along with a hook or ring 28 or like near the base or proximate end of the pole. Also shown is a pole lanyard 30 having a conventional spring loaded connector 32 or like on one end and having the other end connected to the ring 28 near the end of the pole. Also shown is a boat lanyard 34 having an attachment loop, ring or means 36 or like on one end and another attachment loop, ring or means 38 or like on the other end. Also shown is a bracket 40 for holding the pole 22, the bracket having a base 42 wherein U-bolts 44 are used to connect the base to a frame member 20 of the trailer 12. Also shown is a hook 46 mounted onto the base 42 of the pole bracket 40. Bracket 40 is mounted hear the bow of the boat 14 as the boat would be positioned for hauling while on the trailer 12 so that the boat winch 56 is out of the way. Also shown is a tube or pole receiving member 48 which serves as a pole holder for removable insertion of the base or proximate end of the pole 22. The pole holding tube 48, i.e., pole holder, is angularly adjustable about pivot 66 as shown by arrows 64 and uses removable, insertable pin 62 to lock pole 22 in the desired angle. Also shown is a front bow cleat 50 and a rear stern cleat 52 of the boat 14. In FIG. 1, connector 32 and ring 38 are shown disconnected from hook 46 in solid lines and connected to hook 46 in phantom line.

Figure 2:
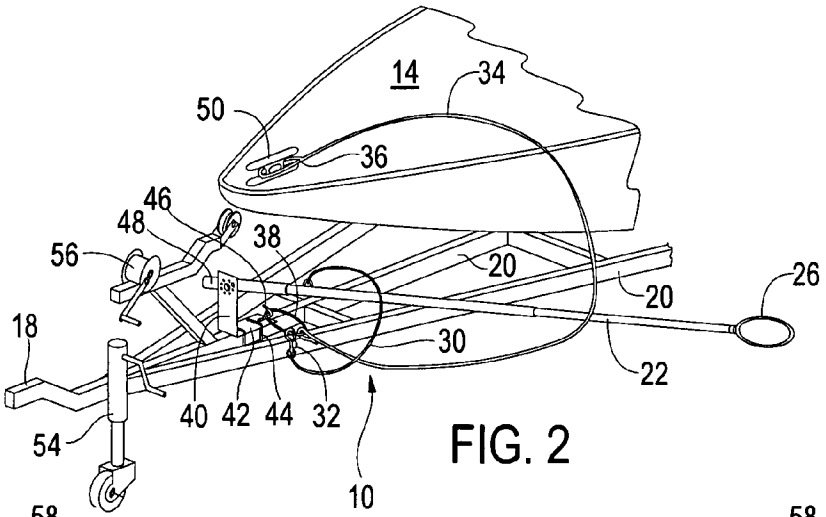
FIGS. 2-4 are perspective views of portions of the present invention.

FIG. 2 is similar to FIG. 1 except that it shows ring 38 attached to hook 46 with connector 32 being attached to ring 38 at the same time so that ring 38 is disconnected from hook 46 when pole 22 is removed from holder 48.

Figure 3:
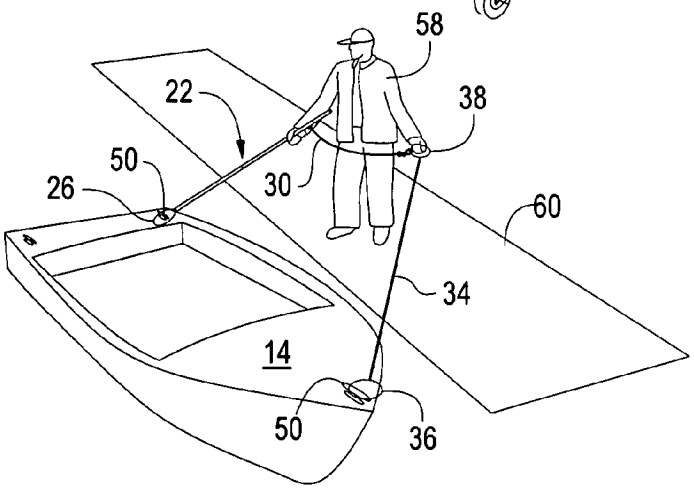

FIG. 3 shows user 58 with pole 22 in one hand and the end 38 of boat lanyard 34 in the other hand with the pole lanyard 38 still connected to end 38 which is expected to be used with shorter boats 14.

Figure 4:
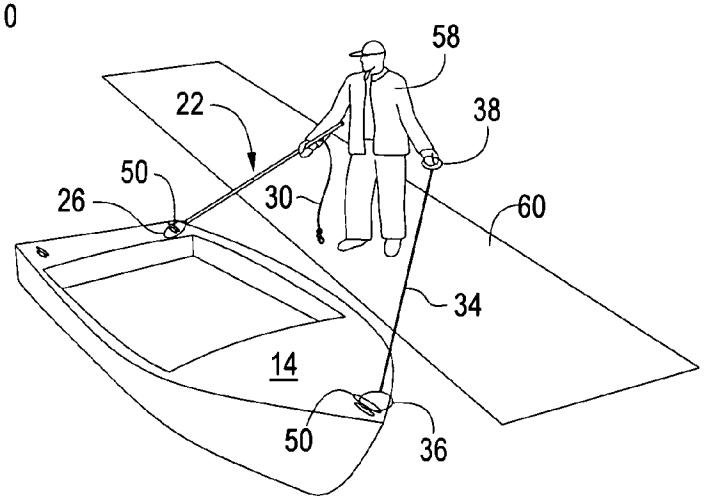

FIG. 4 is similar to FIG. 3 except the pole lanyard 30 is disconnected from ring 38 (the boat lanyard 34) which is expected to be used with boats longer than about 16 feet. FIGS. 3-4 show the position of boat 14 as it would appear in the water although no water is actually shown.

The method of using the present invention may be generally summarized as follows: 1) The user 58 backs watercraft 14 on trailer 12 to the water's edge and prepares to launch from trailer 12 (remove tie downs, insert plug in hull, etc.) and adjust angle of pole holder 48 to desired angle. 2) Attach one end of boat lanyard 34 to boat bow cleat 50, then attach remaining free end (with stainless ring 38) of boat lanyard to hook 46 on bracket 40 which will keep boat 14 from floating away from trailer 12. 3) Extend pole 22 to desired length. 4) Attach connector ring 32 of pole lanyard 30 to ring 38 on boat lanyard 34 while ring 38 is attached to hook 46 and insert base of pole 22 into pole holder tube 48. 5) Slowly back boat 14 into water until boat starts to float free from trailer 12. Insure distal end of pole 22 is free from obstacles, such as overhead trees, electrical power lines, etc., and easily within reach of the user while the user is standing on pier 60. At this time, ring 38 with hook 32 attached thereto is still connected to hook 46 so that boat 14 is secured to trailer 12 so that the boat cannot float away. 6) Secure towing vehicle and walk up on pier and while standing on pier pull pole 22 from holder tube 48 which will remove ring 38 and connector 32 from the hook 46 while holding pole lanyard 30 and boat lanyard 34 and use loop end 26 on pole to hook stern cleat 52 on boat 14 and then maneuver boat to pier using lanyards 30, 34 and pole loop 26. For boats larger than about 16 feet in length it may be necessary to detach pole lanyard 30 from ring 38 on boat lanyard 34 once you have boat lanyard in hand. This will allow the pole 22 to be totally free from boat lanyard 34 to allow a freer and straighter reach of the pole to rear cleat 52 with loop 26.

We claim:

1. An apparatus to aid in launching a watercraft from a trailer into a body of water, comprising:

a) a pole holder mounted on the trailer proximate a bow of the watercraft;

b) a hook mounted on the trailer proximate the bow of the watercraft;

c) a pole having proximate and distal ends, wherein said proximate end of said pole can be removably inserted into said pole holder, a first loop disposed on said distal end of said pole;

d) a pole lanyard having a first end connected proximate to said proximate end of said pole and a second end having a first connector thereon; and, e) a boat lanyard having a first end having a second loop thereon and a second end having an attachment ring thereon to aid in launching the watercraft from the trailer.

2. The apparatus of claim 1, further comprising:

a) wherein said attachment ring of said boat lanyard can be connected to said hook and said second loop of said boat lanyard can be connected to the bow of the watercraft to secure the watercraft on the trailer as the trailer enters the water; and, b) wherein said first connector of said pole lanyard can be connected to said attachment ring of said boat lanyard so that said attachment ring is removed from said hook when said pole is removed from said pole holder.

3. The apparatus of claim 1, wherein said pole holder is angularly adjustable.

4. The apparatus of claim 1, wherein said first pole is length adjustable.

5. The apparatus of claim 1, wherein said first loop on said pole can be used to connect to a stern cleat of the watercraft while said attachment ring is connected to a bow cleat of the bow.

6. A method for launching a watercraft from a trailer into a body of water, comprising the steps of:

a) providing a pole holder mounted on the trailer proximate a bow of the watercraft;

b) providing a hook mounted on the trailer proximate the bow of the watercraft;

c) providing a pole having proximate and distal ends, wherein the proximate end of the pole can be removably inserted into the pole holder, providing a first loop disposed on the distal end of the pole;

d) providing a pole lanyard having a first end connected proximate to the proximate end of the pole and a second end having a first connector therein; and, e) providing a boat lanyard having a first end having a second loop thereon and a second end having an attachment ring thereon to aid in launching the watercraft from the trailer.

7. The method of claim 6, comprising the steps of:

a) connecting the attachment ring of the boat lanyard to the hook and the second loop of the boat lanyard to the bow of the watercraft to secure the watercraft on the trailer as the trailer enters the water; and, b) connecting the first connector of the pole lanyard to the attachment ring of the boat lanyard so that the attachment ring is removed from the hook when the pole is removed from the pole holder.

8. The method of claim 6, wherein the pole holder is angularly adjustable.

9. The method of claim 6, wherein the pole is length adjustable.

10. The method of claim 6, wherein the first loop on the pole can be used to connect to a stern cleat of the watercraft while the attachment ring is connected to a bow cleat of the watercraft.

11. A method of using an aid for launching a boat from a trailer into a body of water, comprising the steps of: a) providing a pole holder mounted on the trailer proximate a bow of the boat; b) providing a hook mounted on the trailer proximate the bow of the boat; c) providing a pole having proximate and distal ends, wherein the proximate end of the pole can be removably inserted into the pole holder, providing a first loop disposed on the distal end of the pole; d) providing a pole lanyard having a first end connected proximate to the proximate end of the pole and a second end having a first connector therein; e) providing a boat lanyard having a first end having a second loop thereon and a second end having an attachment ring thereon to aid in launching the boat from the trailer; f) backing the trailer to the edge of the body of water and preparing to launch the boat from the trailer; g) adjusting an angle of the pole holder to the desired angle; h) attaching the second loop of the boat lanyard to a bow cleat and then attaching the attachment ring of the boat lanyard to the hook which will keep the boat from floating away from the trailer; i) extending the pole to a desired length; j) attaching the first connector of the pole lanyard to the attachment ring on the boat lanyard while the attachment ring is attached to the hook and inserting the base of the pole into the pole holder; k) backing the boat into the water until the boat starts to float free from the trailer; l) securing a towing vehicle and walking up on a pier and while standing on the pier pulling the pole from the pole holder which will remove the attachment ring and first connector from the hook and while holding the pole and the boat lanyard then using the first loop on the pole to hook a stern cleat on the boat; and, m) maneuvering the boat to the pier using the boat lanyard and the pole.

* * * * *